US007712524B2

(12) United States Patent
Patel et al.

(10) Patent No.: US 7,712,524 B2
(45) Date of Patent: May 11, 2010

(54) MEASURING A CHARACTERISTIC OF A WELL PROXIMATE A REGION TO BE GRAVEL PACKED

(75) Inventors: Dinesh R. Patel, Sugar Land, TX (US); Donald W. Ross, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 370 days.

(21) Appl. No.: 11/735,521

(22) Filed: Apr. 16, 2007

(65) Prior Publication Data

US 2007/0235185 A1 Oct. 11, 2007

Related U.S. Application Data

(63) Continuation-in-part of application No. 11/688,089, filed on Mar. 19, 2007.

(60) Provisional application No. 60/787,592, filed on Mar. 30, 2006, provisional application No. 60/745,469, filed on Apr. 24, 2006, provisional application No. 60/747,986, filed on May 23, 2006, provisional application No. 60/805,691, filed on Jun. 23, 2006, provisional application No. 60/865,084, filed on Nov. 9, 2006, provisional application No. 60/866,622, filed on Nov. 21, 2006, provisional application No. 60/867,276, filed on Nov. 27, 2006, provisional application No. 60/890,630, filed on Feb. 20, 2007.

(51) Int. Cl.
*E21B 47/12* (2006.01)
*E21B 43/04* (2006.01)

(52) U.S. Cl. ..... 166/250.01; 166/278; 166/66; 166/242.6

(58) Field of Classification Search ..... 166/250.02, 166/278, 51, 66, 66.6, 242.6, 250.01
See application file for complete search history.

(56) References Cited

U.S. PATENT DOCUMENTS

| | | | | |
|---|---|---|---|---|
| 5,183,110 | A * | 2/1993 | Logan et al. | 166/278 |
| 6,360,820 | B1 | 3/2002 | Laborde | |
| 6,588,507 | B2 | 7/2003 | Dusterhoft | |
| 6,766,857 | B2 * | 7/2004 | Bixenman et al. | 166/278 |
| 6,789,621 | B2 | 9/2004 | Wetzel | |
| 6,817,410 | B2 | 11/2004 | Wetzel | |
| 6,983,796 | B2 * | 1/2006 | Bayne et al. | 166/278 |
| 7,100,690 | B2 | 9/2006 | Mullen | |
| 7,104,324 | B2 | 9/2006 | Wetzel | |
| 7,147,054 | B2 | 12/2006 | Wang | |

(Continued)

FOREIGN PATENT DOCUMENTS

| | | |
|---|---|---|
| GB | 2395965 | 6/2004 |

(Continued)

*Primary Examiner*—Kenneth Thompson
(74) *Attorney, Agent, or Firm*—Trop, Pruner & Hu, P.C.; Daryl R. Wright; Kevin B. McGoff

(57) ABSTRACT

A gravel pack service tool is lowered into a well. At least one sensor proximate a well region to be gravel packed measures at least one characteristic of the well, where the measuring is performed during a gravel pack operation by the gravel pack service tool. The gravel pack service tool is removed from the well after the gravel pack operation.

18 Claims, 9 Drawing Sheets

U.S. PATENT DOCUMENTS

| | | | |
|---|---|---|---|
| 7,182,134 | B2 | 2/2007 | Wetzel |
| 2002/0007948 | A1 | 1/2002 | Bayne et al. |
| 2004/0173352 | A1 | 9/2004 | Mullen et al. |
| 2005/0074210 | A1 | 4/2005 | Grigsby et al. |
| 2005/0092488 | A1 | 5/2005 | Rodet et al. |
| 2005/0168349 | A1 | 8/2005 | Huang |
| 2005/0194150 | A1 | 9/2005 | Ringgenberg |
| 2005/0274513 | A1 | 12/2005 | Schultz et al. |
| 2006/0060352 | A1 * | 3/2006 | Vidrine et al. ..... 166/276 |

FOREIGN PATENT DOCUMENTS

| | | | |
|---|---|---|---|
| GB | 2409692 | A | 7/2005 |
| GB | 2426019 | | 11/2006 |
| GB | 2428787 | A | 2/2007 |
| WO | 2007002767 | A1 | 3/2007 |

* cited by examiner

MEASURING A CHARACTERISTIC OF A WELL PROXIMATE A REGION TO BE GRAVEL PACKED

CROSS-REFERENCE TO RELATED APPLICATIONS

This claims the benefit under 35 U.S.C. §119(e) of U.S. Provisional Application Ser. No. 60/747,986, entitled "A Method for Providing Measurement System During Sand Control Operation and Then Converting It to Permanent Measurement System," filed May 23, 2006. This is a continuation-in-part of U.S. Ser. No. 11/688,089, entitled "Completion System Having a Sand Control Assembly, an Inductive Coupler, and a Sensor Proximate the Sand Control Assembly," filed Mar. 19, 2007, which claims the benefit under 35 U.S.C. §119(e) of the following provisional patent applications: U.S. Ser. No. 60/787,592, entitled "Method for Placing Sensor Arrays in the Sand Face Completion," filed Mar. 30, 2006; U.S. Ser. No. 60/745,469, entitled "Method for Placing Flow Control in a Temperature Sensor Array Completion," filed Apr. 24, 2006; U.S. Ser. No. 60/747,986, entitled "A Method for Providing Measurement System During Sand Control Operation and Then Converting It to Permanent Measurement System," filed May 23, 2006; U.S. Ser. No. 60/805,691, entitled "Sand Face Measurement System and Re-Closeable Formation Isolation Valve in ESP Completion," filed Jun. 23, 2006; U.S. Ser. No. 60/865,084, entitled "Welded, Purged and Pressure Tested Permanent Downhole Cable and Sensor Array," filed Nov. 9, 2006; U.S. Ser. No. 60/866,622, entitled "Method for Placing Sensor Arrays in the Sand Face Completion," filed Nov. 21, 2006; U.S. Ser. No. 60/867,276, entitled "Method for Smart Well," filed Nov. 27, 2006 and U.S. Ser. No. 60/890,630, entitled "Method and Apparatus to Derive Flow Properties Within a Wellbore," filed Feb. 20, 2007. Each of the above applications is hereby incorporated by reference.

TECHNICAL FIELD

The invention relates generally to measuring, with at least one sensor located proximate to a well region to be gravel packed, a characteristic of a well.

BACKGROUND

A completion system is installed in a well to produce hydrocarbons (or other types of fluids) from reservoir(s) adjacent the well, or to inject fluids into the well. To perform sand control (or control of other particulate material), gravel packing is typically performed. Gravel packing involves the pumping of a gravel slurry into a well to pack a particular region (typically an annulus region) of the well with gravel.

Achieving a full pack is desirable for long-term reliability of sand control operation. Various techniques, such as shunt tubes or beta wave attenuators can be used for achieving a full pack. However, in conventional systems, there typically does not exist a mechanism to efficiently provide real-time feedback to the surface during a gravel packing operation.

SUMMARY

In general, a method for using a well includes lowering a gravel packing tool into the well, and measuring, with at least one sensor located proximate a well region to be gravel packed, at least one characteristic of the well. The measuring is performed during a gravel pack operation by the gravel-packing tool. After the gravel pack operation, the gravel packing tool is removed from the well.

Other or alternative features will become apparent from the following description, from the drawings, and from the claims.

DETAILED DESCRIPTION

Figure 1:
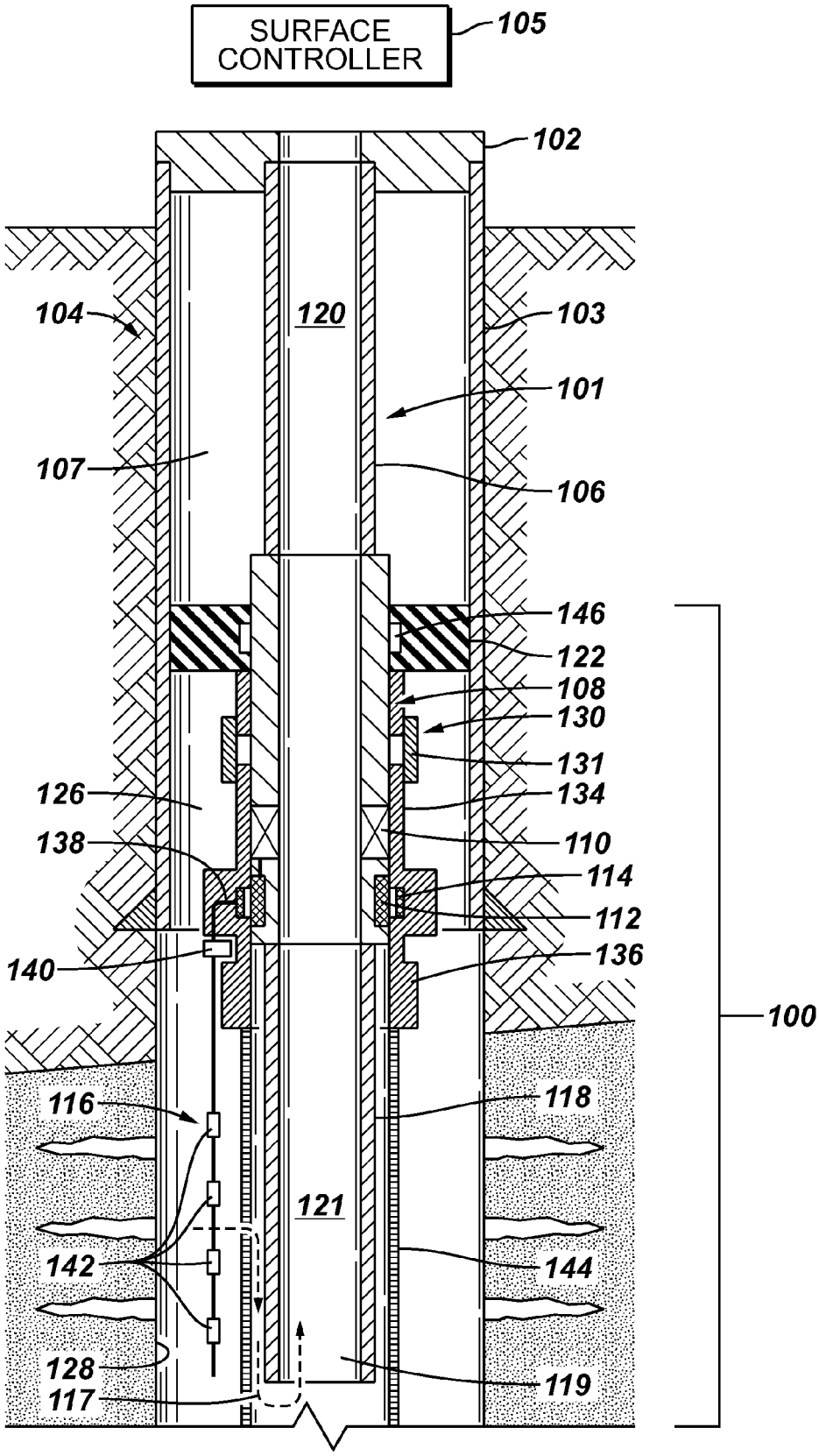
FIG. 1 illustrates an example completion system having a gravel pack service tool in a lower completion section, in accordance with an embodiment.

In the following description, numerous details are set forth to provide an understanding of the present invention. However, it will be understood by those skilled in the art that the present invention may be practiced without these details and that numerous variations or modifications from the described embodiments are possible.

As used here, the terms "above" and "below"; "up" and "down"; "upper" and "lower"; "upwardly" and "downwardly"; and other like terms indicating relative positions above or below a given point or element are used in this description to more clearly describe some embodiments of the invention. However, when applied to equipment and methods for use in wells that are deviated or horizontal, such terms may refer to a left to right, right to left, or diagonal relationship as appropriate.

In accordance with some embodiments, a completion system is provided for installation in a well, where the completion system is used for performing a gravel pack operation in a target well region. A "gravel pack operation" refers to an operation in a well in which gravel (fragments of rock or other material) is injected into the target well region for the purpose of preventing passage of particulates, such as sand. At least one sensor is provided in the completion system to allow for real-time monitoring of well characteristics during the gravel pack operation. "Real-time monitoring" refers to the ability to observe downhole parameters (representing well characteristics) during some operation performed in the well, such as the gravel pack operation. Example characteristics that are monitored include temperature, pressure, flow rate, fluid density, reservoir resistivity, oil/gas/water ratio, viscosity, carbon-oxygen ratio, acoustic parameters, chemical sensing (such as for scale, wax, asphaltenes, deposition, pH sensing, salinity sensing), and so forth. The well can be an offshore well or a land-based well.

The gravel pack operation is performed with a retrievable gravel pack service tool that can be retrieved from the well after completion of gravel packing. After the gravel pack service tool is removed from the well, a lower completion section of the completion system remains in the well. Also, following removal of the gravel pack service tool, an upper completion section can be installed in the well for engagement with the lower completion section to form a permanent completion system to enable the production and/or injection of fluids (e.g., hydrocarbons) in the well.

The gravel pack operation can be performed in an open well region. In such a scenario, a sensor assembly (such as in the form of a sensor array of multiple sensors) can be placed at multiple discrete locations across a sand face in the well region. A "sand face" refers to a region of the well that is not lined with a casing or liner. In other implementations, the sensor assembly can be placed in a lined or a cased section of the well. The sensors of the sensor assembly are positioned proximate the well region to be gravel packed. A sensor is "proximate" the well region to be gravel packed if it is in a zone to be gravel packed.

FIG. 1 illustrates a first arrangement of a completion system. As depicted, a work string 101 extends from wellhead equipment 102 into a well 104. The work string 101 includes a tubing (or pipe) 106 that is connected to a gravel pack service tool 108 at the lower end of the tubing 106. The tubing 106 can be a drill pipe, for example. Note that the terms "tubing" and "pipe" are used interchangeably, and refer to any structure defining an inner longitudinal flow conduit.

The gravel pack service tool 108 includes a control station 110, which can be a downhole controller to perform various operations in the well 104. The control station 110 can include a processor and a power and telemetry module to allow communication with downhole devices and with surface equipment. The gravel pack service tool 108 also has an energy source in the power and telemetry module to supply power to downhole electrical devices. Optionally, the control station 110 can also include one or more sensors, such as pressure and/or temperature sensors.

In one implementation, to avoid running an electrical line from the earth surface to the control station 110, the telemetry module in the control station 110 can be a wireless telemetry module to enable wireless communication through the well 104. Examples of wireless communication include acoustic communication, electromagnetic (EM) communication, pressure pulse communication, and so forth. Acoustic communication refers to using encoded acoustic waves transmitted through a wellbore. EM communication refers to using encoded EM waves transmitted through the wellbore. Pressure pulse communication refers to using encoded low pressure pulses (such as according to IRIS, or Intelligent Remote Implementation System, as provided by Schlumberger) transmitted through the wellbore.

The gravel pack service tool 108 also includes a first inductive coupler portion 112 that is carried into the well 104 with the gravel pack service tool 108. The first inductive coupler portion 112 can be positioned adjacent a second inductive coupler portion 114 that is part of a lower completion section 100 of the completion system depicted in FIG. 1. The first and second inductive coupler portions 112, 114 make up an inductive coupler to enable communication of power and data between the control station 110 and a sensor assembly 116 that is also part of the lower completion section 100. The first inductive coupler portion 112 can be a male inductive coupler portion, whereas the second inductive coupler portion 114 can be a female inductive coupler portion.

The inductive coupler portions 112, 114 perform communication using induction. Induction is used to indicate transference of a time-changing electromagnetic signal or power that does not rely upon a closed electrical circuit, but instead includes a component that is wireless. For example, if a time-changing current is passed through a coil, then a consequence of the time variation is that an electromagnetic field will be generated in the medium surrounding the coil. If a second coil is placed into that electromagnetic field, then a voltage will be generated on that second coil, which we refer to as the induced voltage. The efficiency of this inductive coupling increases as the coils are placed closer, but this is not a necessary constraint. For example, if time-changing current is passed through a coil is wrapped around a metallic mandrel, then a voltage will be induced on a coil wrapped around that same mandrel at some distance displaced from the first coil. In this way, a single transmitter can be used to power or communicate with multiple sensors along the wellbore. Given enough power, the transmission distance can be very large. For example, solenoidal coils on the surface of the earth can be used to inductively communicate with subterranean coils deep within a wellbore. Also note that the coils do not have to be wrapped as solenoids. Another example of inductive coupling occurs when a coil is wrapped as a toroid around a metal mandrel, and a voltage is induced on a second toroid some distance removed from the first.

The work string 101 further includes a wash pipe 118 provided below the gravel pack service tool 108. The wash pipe 118 is used to carry excess fluid resulting from a gravel pack operation back up to the well surface through the inner bore of the wash pipe 118 and then through the casing annulus 107. A cross-over assembly (not shown) in the gravel pack service tool allows fluid from wash pipe inner bore to cross over to the casing annulus.

The lower completion section 100 further includes a gravel pack packer 122 that is set against casing 103 that lines a portion of the well 104. Note that in FIG. 1, part of an annulus well region 126 to be gravel packed is un-lined with the casing 103, while another part of the annulus well region 126 is lined with the casing 103. The un-lined part of the annulus well region 126 has a sand face 128. In an alternative implementation, the casing 103 can extend, or a liner can be run through the annulus well region 126 to be gravel packed. In this alternative embodiment, perforations can be formed in the casing 103 or a liner to allow for communication of well fluids between the wellbore and the surrounding reservoir.

The lower completion section 100 further includes a circulating port assembly 130 that is actuatable to control flow in the system depicted in FIG. 1. Note that the circulating port assembly can be made up of multiple valves to enable cross-over flow. Only a port closure sleeve 131 to enable communication between the tubing inner bore 120 and the annulus well region 126 is depicted in FIG. 1. Gravel slurry can be injected from the earth surface into the inner bore 120 of the tubing 106 to pass through the circulating port assembly 130 (when the port closure sleeve depicted in FIG. 1 is open) into the annulus well region 126 to be gravel packed. Return flow of carrier fluid of the gravel slurry flows from the well annulus region 126 and passes through a sand control assembly 144 (e.g., a sand screen, perforated or slotted pipe, etc.) of the lower completion section 100. The return flow path is represented as path 117 in FIG. 1. The return carrier fluid enters through the lower end 119 of the wash pipe 118 and flows upwardly through an inner bore 121 of the wash pipe 118. The carrier flow continues to the circulating port assembly 130, which has a cross-over flow path to direct the return flow to the annular region 107 above the packer 122 and between the tubing 106 and casing 103.

The valves of the circulating port assembly 130 can be actuated using a number of different mechanisms, including electrically with the control station 110, hydraulically with application of well pressure, mechanically with an intervention tool or by manipulation of the work string 101, or by some other actuating mechanism.

The lower completion section 100 further includes a housing section 134 below the circulating port assembly 130, where the housing section 134 includes the second inductive coupler portion 114.

Below the second inductive coupler portion 114 is a formation isolation valve 136, which can be implemented with a ball valve or a mechanical fluid loss control valve with a flapper. When closed, the formation isolation valve 136 prevents fluid communication between the inner bore 120 above the formation isolation valve 136 and the inner bore 121 below the formation isolation valve 136.

One or more electrical conductors 138 connect the second inductive coupler portion 114 to a controller cartridge 140. Note that in other embodiments, the controller cartridge 140 can be omitted. The controller cartridge 140 is in turn able to communicate with the sensor assembly 116 that includes multiple discrete sensors 142 located at corresponding discrete locations across the annulus well region 126 to be gravel packed. The controller cartridge 140 is able to receive commands from another location (such as from a surface controller 105 at the earth surface or from the control station 110). These commands can instruct the controller cartridge 140 to cause the sensors 140 to take measurements. Also, the controller cartridge 140 is able to store and communicate measurement data from the sensors 140. Thus, at periodic intervals, or in response to commands, the controller cartridge 140 is able to communicate the measurement data to another component (e.g., the control station 110 or surface controller 105) that is located elsewhere in the wellbore or at the earth surface. Generally, the controller cartridge 140 includes a processor and storage. In embodiments where the controller cartridge 140 is omitted, the sensors 142 of the sensor assembly 116 can communicate with the control station 110 through the inductive coupler. The control station 110 is able to store and communicate the data. In yet another embodiment, the control station 110 can also be omitted, in which case the sensors 142 can communicate with the surface controller 105 directly through the inductive coupler portions 112, 114. In cases where there is no wireless communication or any other means of communication from controller 110 to surface, data from the sensors are stored in the control station and then retrieved upon retrieval of the control station to surface.

In some embodiments, the sensor assembly 116 is in the form of a sensor cable (also referred to as a "sensor bridle"). The sensor cable 116 is basically a continuous control line having portions in which sensors are provided. The sensor cable 116 is "continuous" in the sense that the sensor cable provides a continuous seal against fluids, such as wellbore fluids, along its length. Note that in some embodiments, the continuous sensor cable can actually have discrete housing sections that are sealably attached together. In other embodiments, the sensor cable can be implemented with an integrated, continuous housing without breaks. Further details regarding sensor cables are provided in U.S. patent application entitled "Completion System Having a Sand Control Assembly, an Inductive Coupler, and a Sensor Proximate the Sand Control Assembly," referenced above.

As further depicted in FIG. 1, the sand control assembly 144 is provided below the formation isolation valve 136 in the lower completion section 100. The sand control assembly 144 is used to prevent passage of particulates, such as sand, so that such particulates do not flow from the surrounding reservoir into the well.

In operation, the lower completion section 100 is run into the well, with the gravel packer 122 set to fix the lower completion section 100 in the well. Next, the work string 101 is run into the well 104 and engaged with the lower completion section 100. As depicted in FIG. 1, a snap latch mechanism 146 is provided to allow the work string 101 to be engaged with the gravel pack packer 122 of the lower completion section 100. When the work string 101 and lower completion section 100 are engaged, the male inductive coupler portion 112 of the gravel pack service tool 108 is positioned adjacent the female inductive coupler portion 114 of the lower completion section.

Next, gravel slurry is pumped down the inner bore 120 of the work string 101. The circulating port assembly 130 is actuated to allow the gravel slurry to exit the inner bore 120 of the work string 101 into the annulus well region 126. The gravel slurry fills the annulus well region 126. Upon slurry dehydration, gravel grains pack tightly together so that the final gravel fills the annulus well region 126. The gravel remaining in the annulus well region 126 is referred to as a gravel pack.

Some of the carrier fluid from the gravel slurry flows into the surrounding reservoir from the annulus well region 126. The remaining part of the carrier fluid flows radially through the sand screen 114 and enters the wash pipe 118 from its lower end (following path 117). The carrier fluid is carried to the earth surface through the circulating port assembly 130 and annular region 107. In a different implementation, gravel slurry can be pumped down the annular region 107, and return carrier fluid can flow back up through the inner bore 120 of the tubing 106.

The sensor assembly 116 is positioned in the well annulus region 126 to allow for real-time measurements to be taken in the annulus well region 126 during the gravel pack operation. Thus, during the gravel pack operation, the control station 110 is able to receive measurement data from the sensors 142 of the sensor assembly 116. The measurement data can be communicated in real-time to the earth surface for monitoring by a well operator or stored downhole in the control station 110.

The ability to monitor well characteristics in the annulus well region 126 during the gravel pack operation allows for a real-time health check of the gravel pack operation before the gravel pack service tool 108 is removed from the well 104. This allows the well operator to determine whether the gravel pack operation is proceeding properly, and to take remedial action if anomalies are detected.

Figure 2:
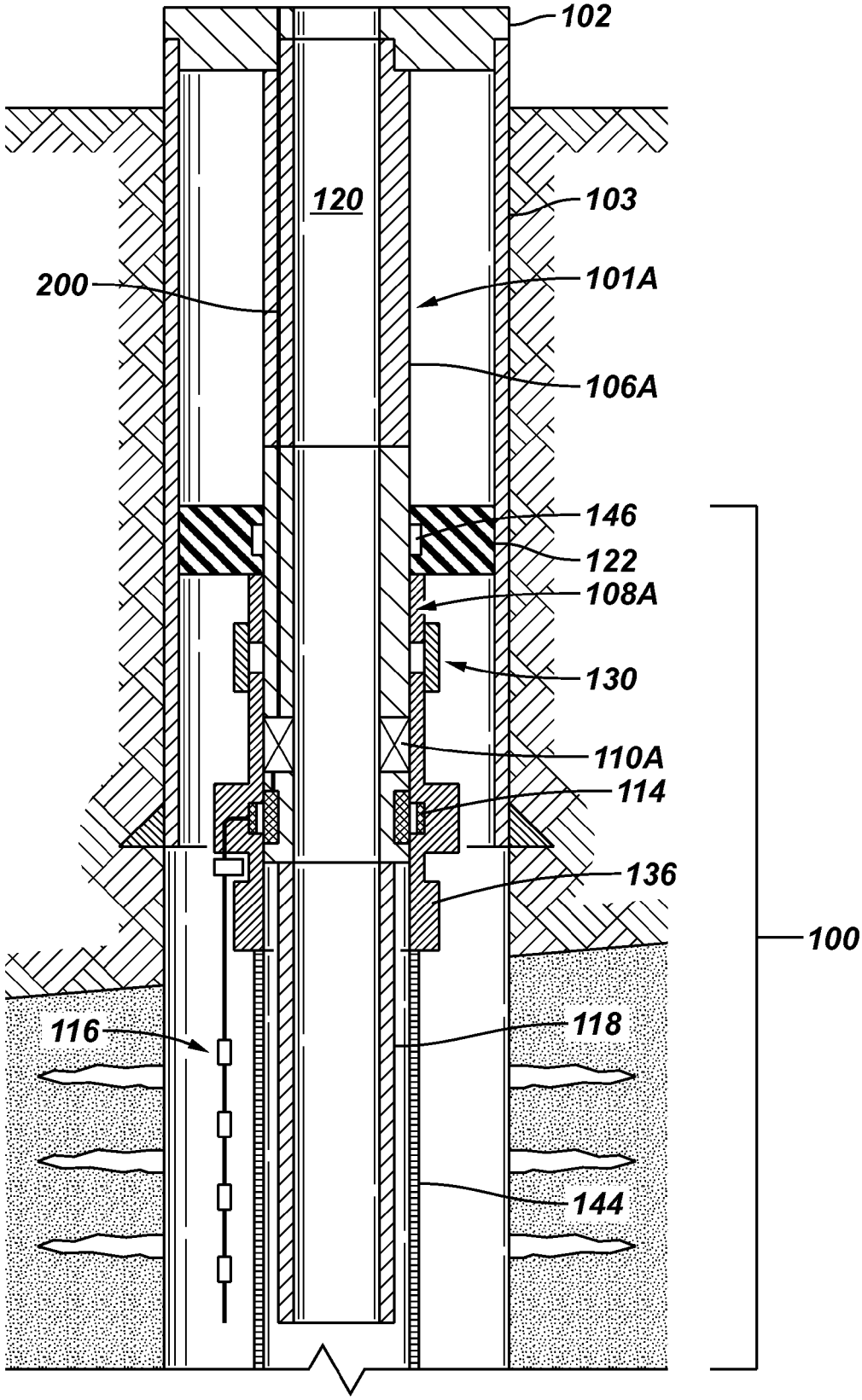
FIGS. 2-5 illustrate completion systems including a gravel pack service tool and a lower completion section, according to other embodiments.

FIG. 2 shows a variant of the FIG. 1 completion system in which wired telemetry (instead of wireless telemetry) is used by the control station, in this case control station 110A. The control station 110A is connected to an electric cable 200 that is embedded in a housing of a tubing 106A of a work string 101A. The tubing 106A is effectively a wired tubing or wired pipe that allows for communication between the earth surface and the control station 110A. The tubing housing defines a longitudinal conduit embedded therein. The embedded cable 200 runs in the embedded longitudinal conduit. Note that this longitudinal conduit that is embedded in the tubing housing is separate from the inner longitudinal bore 120 of the tubing 106A. The remaining parts of the completion system of FIG. 2 are the same as the completion system of FIG. 1.

Figure 3:
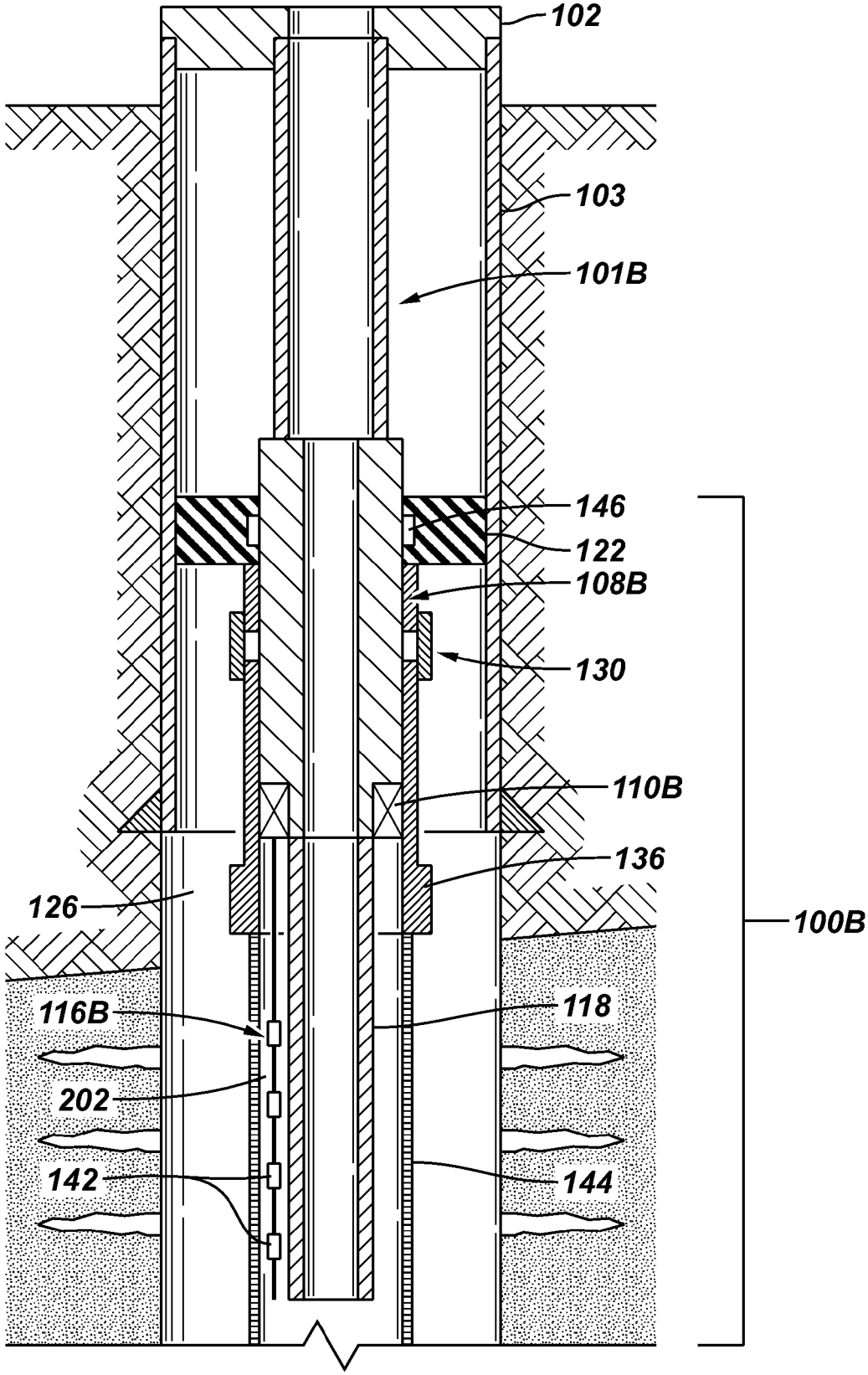

FIG. 3 shows an alternative arrangement of a completion system in which a sensor assembly 116B is provided with a work string 101B instead of with the lower completion section 100B. Thus, as depicted in FIG. 3, the lower completion section 100B has the same components as the lower completion section 100 of FIG. 1, except the sensor cable 116, controller cartridge 140, and second inductive coupler portion 14 of FIG. 1 have been omitted.

In the FIG. 3 embodiment, the gravel pack service tool 108B similarly includes a control station 110B, except in this case, the control station 110B is electrically connected to the sensor assembly 116B. The sensor assembly 116B can be a sensor cable that is electrically connected to the control station 110B.

In the arrangement of FIG. 3, the sensor assembly 116B is positioned inside the sand control assembly 144 of the lower completion section 100B. This is contrasted with the sensor assembly 116 that is positioned outside the sand control assembly 144 in the FIG. 1 embodiment. In the FIG. 3 embodiment, the sensor assembly 116B is provided in an annular region 202 between the wash pipe 118 and the sand control assembly 144.

In the arrangement of FIG. 3, the sensors 142 of the sensor assembly 116B are able to monitor characteristics of carrier fluid flowing from the annulus well region 126 through the sand control assembly 144 into the annular region 202.

Figure 4:
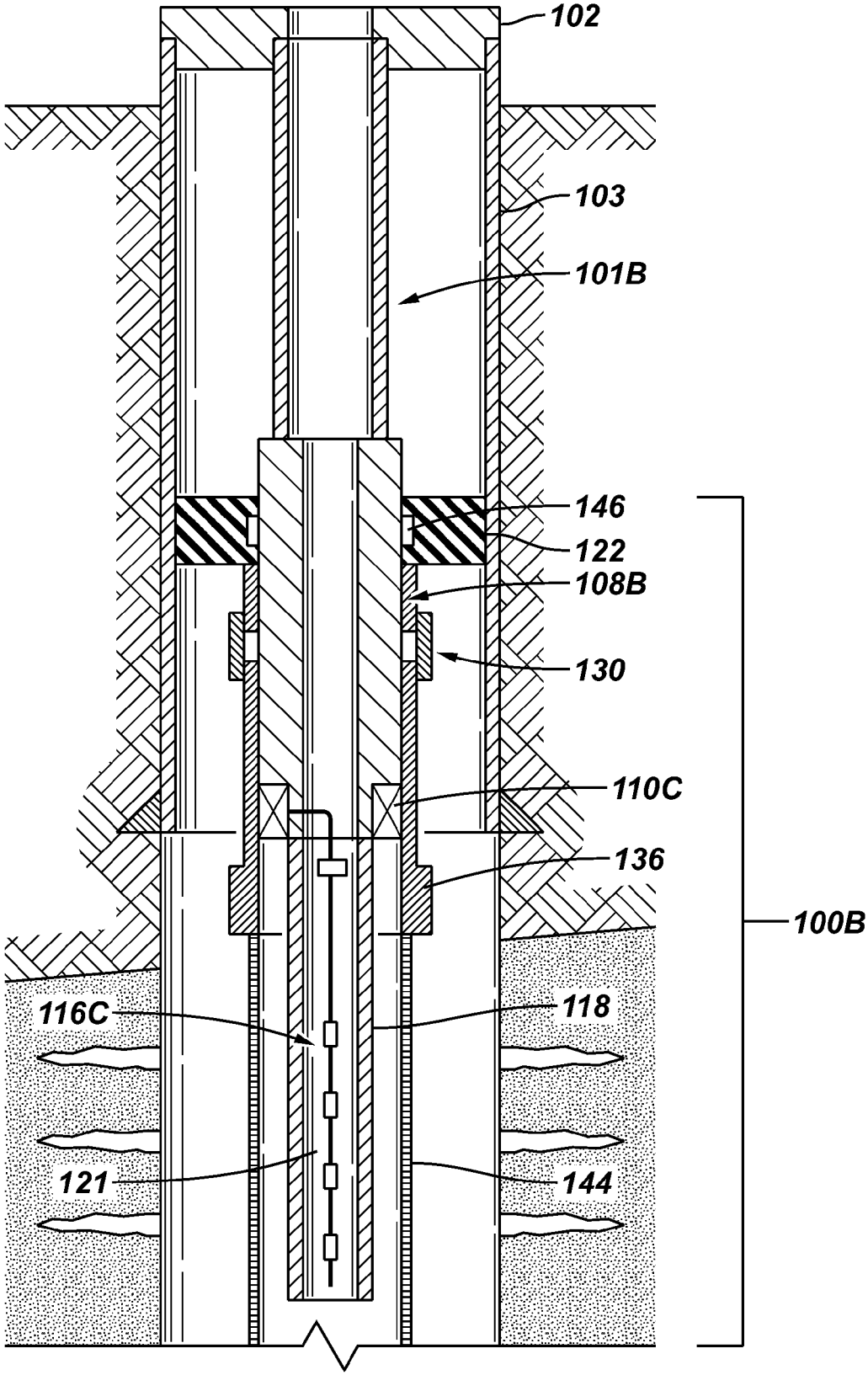

FIG. 4 illustrates a variant of the FIG. 3 embodiment, in which a sensor assembly 116C is positioned inside the wash pipe 118 (in other words, the sensor assembly 116C is positioned in the inner bore 121 of the wash pipe 118). The sensors 142 can monitor characteristics of the carrier fluid after the fluid enters the inner bore 121 of the wash pipe 118. The sensor assembly 116C is electrically connected to a control station 110C. Note that each of the control stations 110B and 110C of FIGS. 3 and 4, respectively, includes a wireless telemetry module to allow wireless communication with a surface controller at the earth surface.

Figure 5:
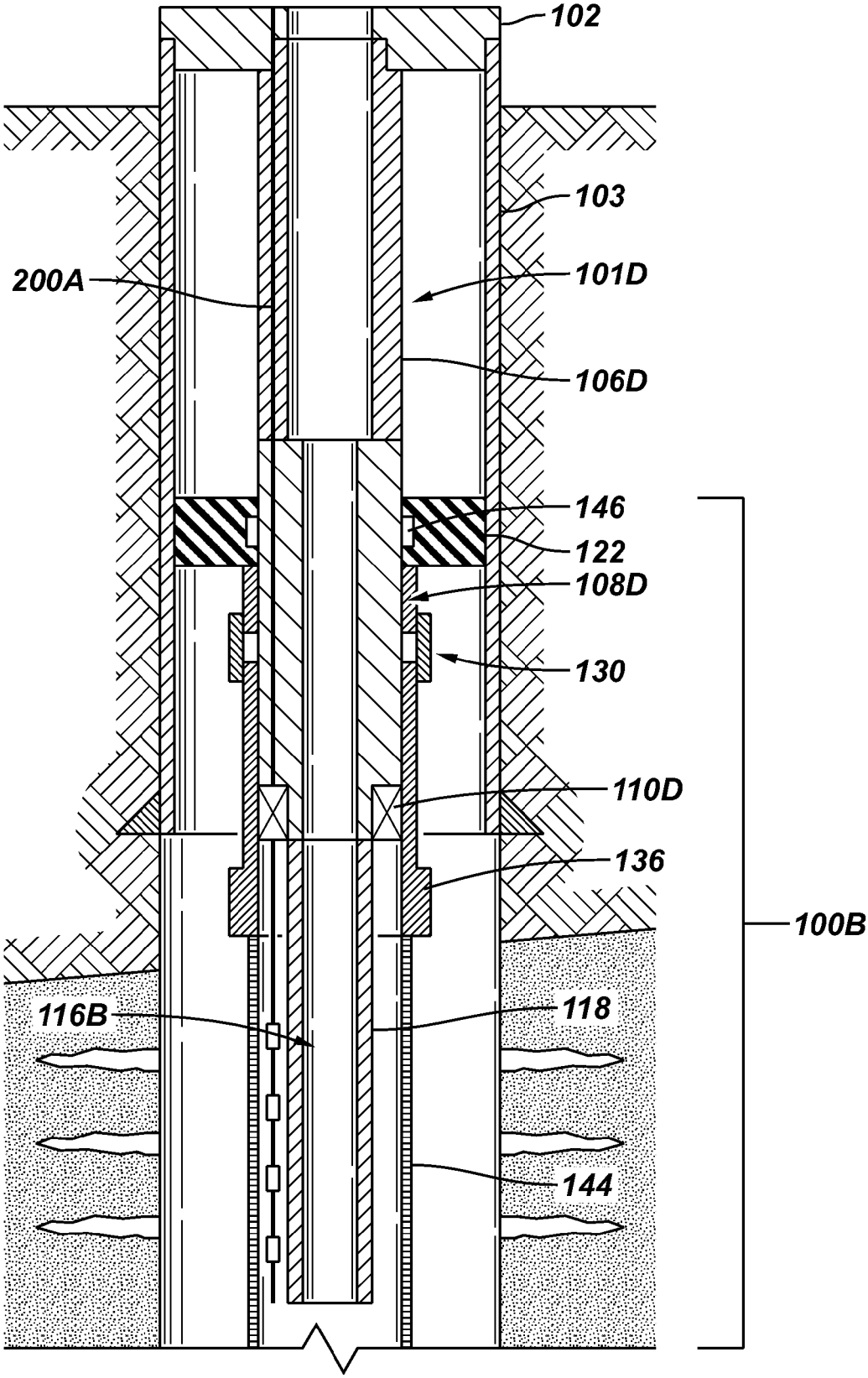

In an alternative embodiment, as depicted in FIG. 5, a wired tubing 106D is part of work string 101D. In this embodiment, a control station 110D, part of the gravel pack service tool 108D, includes a telemetry module for wired communication through the wired tubing 106D with a surface controller. The FIG. 5 embodiment is a variant of the FIG. 3 embodiment. In FIG. 5, the control station 110D is electrically connected over an electric cable 200A embedded in the tubing 106D to the surface controller.

After completion of a gravel pack operation, the work string in any of the embodiments of FIGS. 1-4 can be pulled from the well, leaving just the lower completion section. Referring specifically to the example of FIGS. 1 and 6, the work string 101 can be retrieved from the well 104 to leave just the lower completion section 100 in the well 104 (as shown in FIG. 6).

Figure 6:
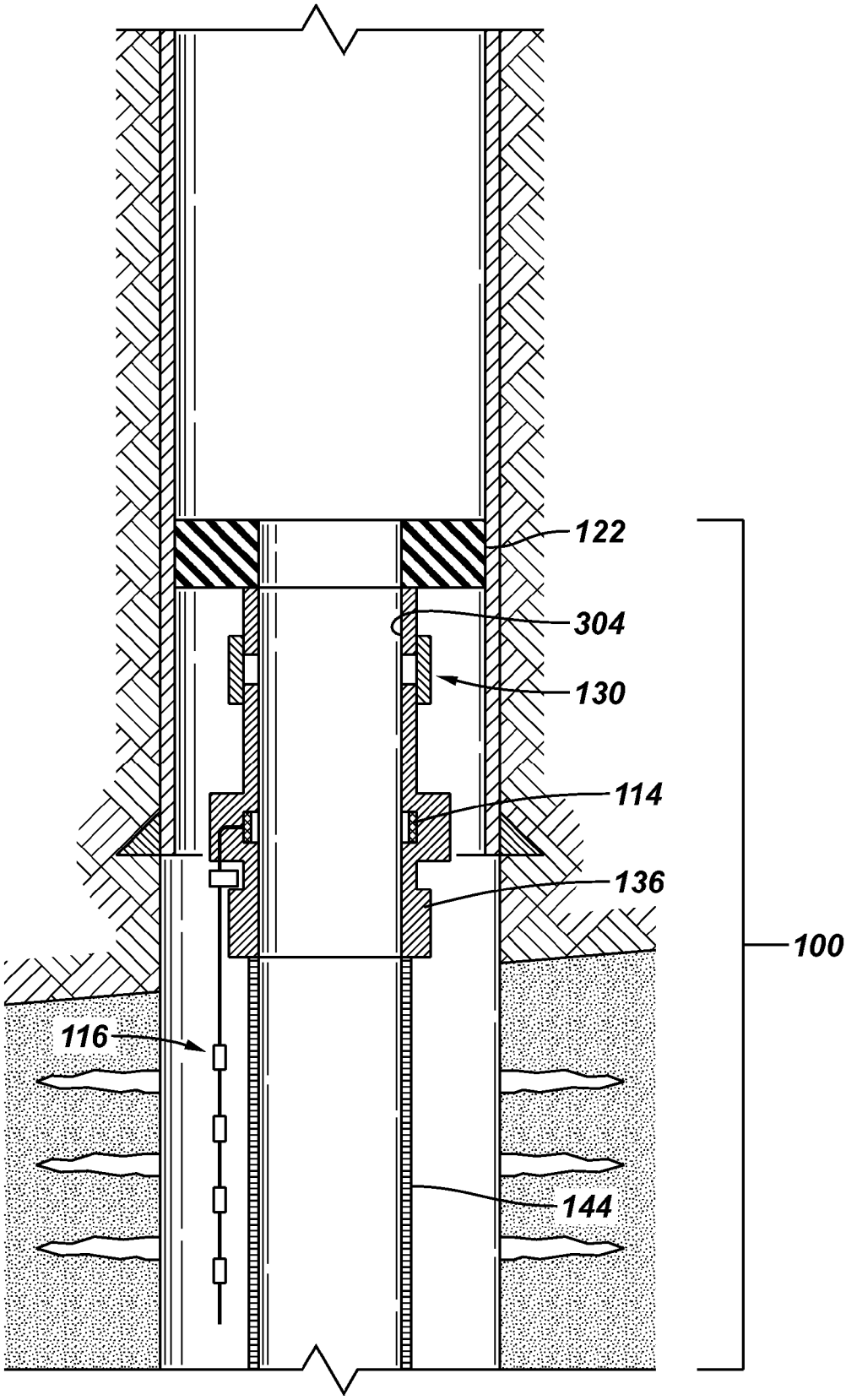
FIG. 6 illustrates the lower completion section that remains in the well after the gravel pack service tool of FIG. 1 has been removed from the well.
Figure 7:
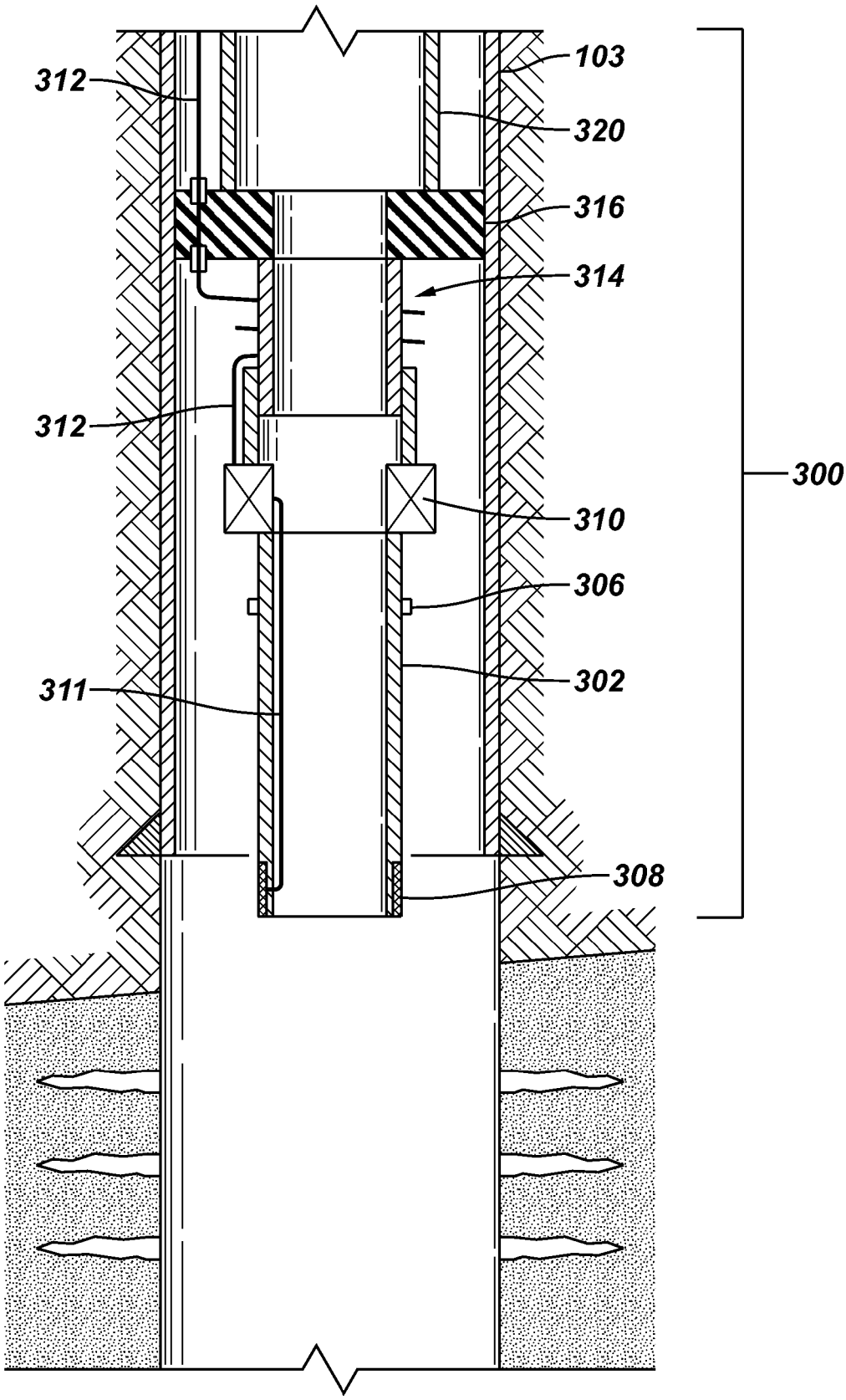
FIG. 7 shows an upper completion section that can be installed in the well after removal of the gravel pack service tool.

After pull-out of the work string 101, an upper completion section 300, as depicted in FIG. 7, can then be run into the well 104 on a tubing 320. The upper completion section 300 has a straddle seal assembly 302 that is able to sealingly engage inside a receptacle (or seal bore) 304 (FIG. 6) of the lower completion section 100 to isolate the port closure sleeve. The outer diameter of the straddle seal assembly 302 of the upper completion section 300 is slightly smaller than the inner diameter of the receptacle 304 of the tower completion section 100. This allows the upper completion section straddle seal assembly 302 to sealingly slide into the receptacle 304 in the lower completion section 100.

Figure 8:
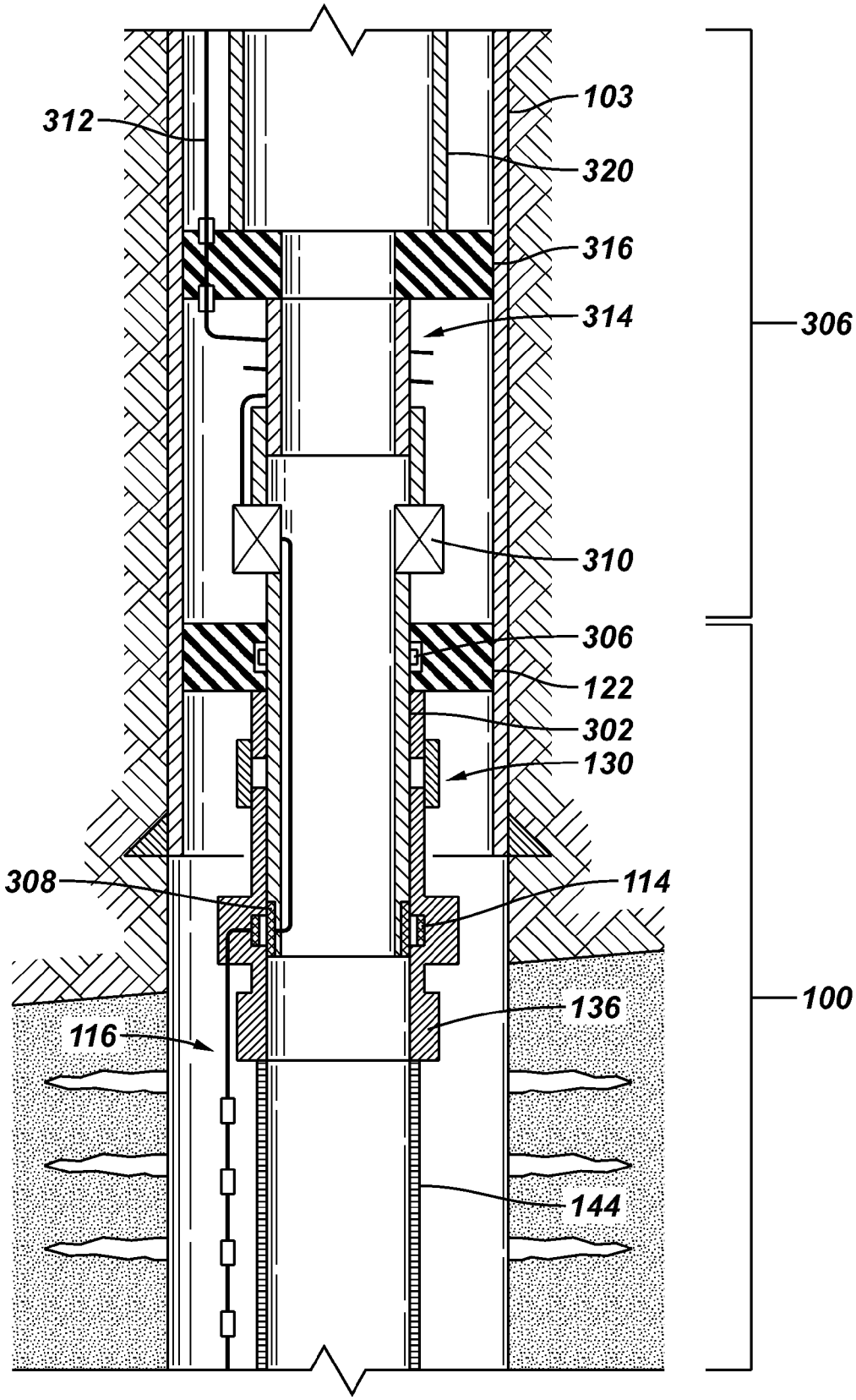
FIG. 8 illustrates a permanent completion system including the upper completion section and the tower completion section of FIG. 7, according to an embodiment.

Arranged on the outside of the upper completion section 300 is a snap latch 306 that allows for engagement with the gravel pack packer 122 in the lower completion section 100 (FIG. 6). When the snap latch 306 is engaged in the packer 122, as depicted in FIG. 8, the upper completion section 300 is securely engaged with the lower completion section 100. In other implementations, other engagement mechanisms can be employed instead of the snap latch 306.

As shown in FIG. 8, the lower potion of the straddle seal assembly 302 has an inductive coupler portion 308 (e.g., male inductive coupler portion) that can be positioned adjacent the female inductive coupler portion 114 of the lower completion section 100. The male inductive coupler portion 308 when positioned adjacent the female inductive coupler portion 114 provides an inductive coupler that allows for communication of power and data with the sensor assembly 116 of the lower completion section 100.

An electrical conductor 311 extends from the inductive coupler portion 308 to a control station 310 that is part of the upper completion section 300. As with the control station 110 in the gravel pack service tool 108 of FIG. 1, the control station 310 also includes a processor, a power and telemetry module (to supply power and to communicate signaling), and optional sensors, such as temperature and/or pressure sensors. The control station 310 is connected to an electric cable 312 that extends upwardly to a contraction joint 314. At the contraction joint 314, the electric cable 312 can be wound in a spiral fashion until the electric cable reaches an upper packer 316 in the upper completion section 300. The upper packer 316 is a ported packet to allow the electric cable 312 to extend through the packer 316 to above the ported packer 316. The electric cable 312 can extend from the packer 316 all the way to the earth surface (or to another location in the well).

Once the upper and lower completion sections are engaged, communication between the controller cartridge 140 and the control station 310 can be performed through the inductive coupler that includes inductive coupler portions 114 and 308. The upper and lower completion sections 300, 100 make up a permanent completion system in which a well operation can be performed, such as fluid production or fluid injection. The sensor assembly 116 that remains in the lower completion section 100 is able to make measurements during the well operation performed with the completion system including the upper and lower completion sections 300, 100.

Figure 9:
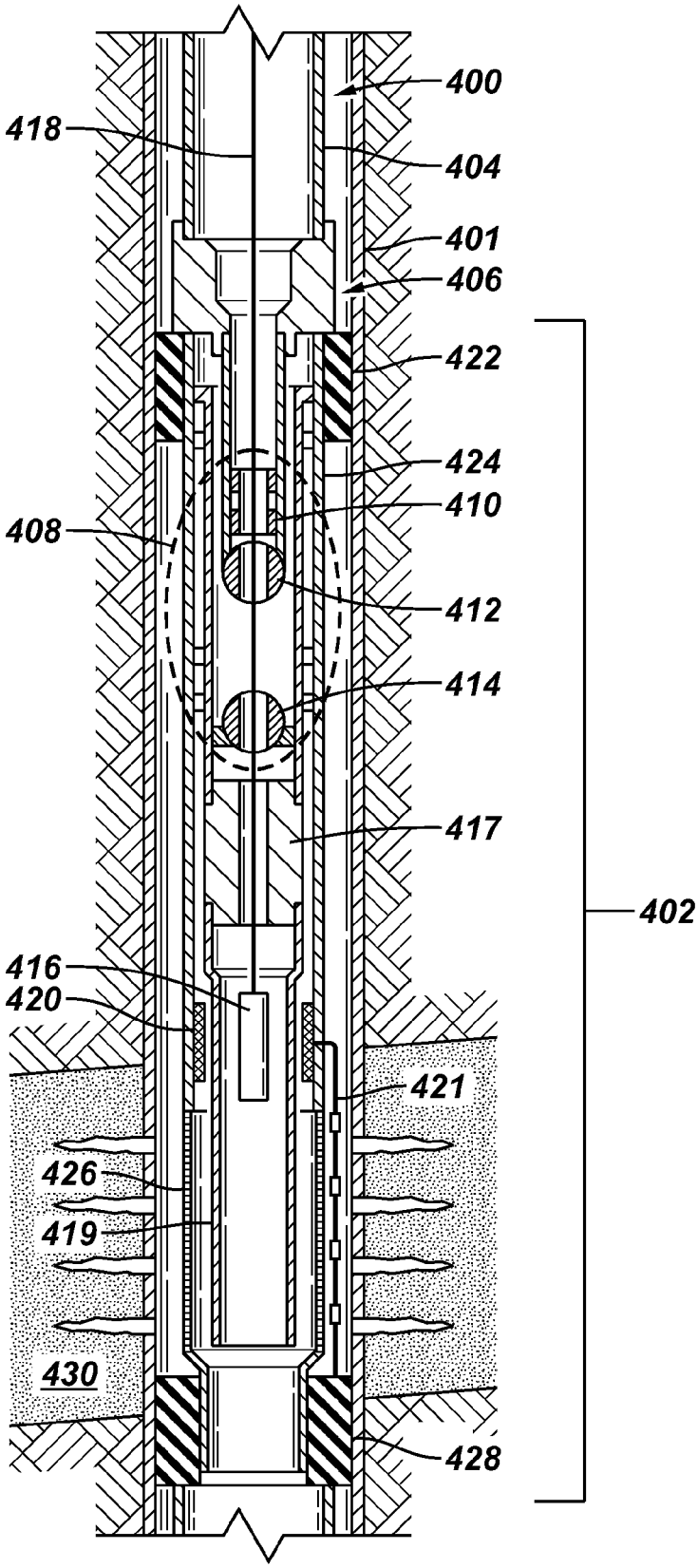
FIG. 9 illustrates another embodiment of a completion system having a gravel pack service tool.

FIG. 9 shows another embodiment of a completion system that includes a work string 400 and a lower completion section 402. The work string 400 includes a tubing 404 that extends to the earth surface, and an attached gravel pack service tool 406. The gravel pack service tool 406 has a valve assembly 408 (which includes a sleeve valve 410, a first ball valve 412, and a second ball valve 414). The work string 400 further includes a wash pipe 419 below a control station 417.

As depicted in FIG. 9, both ball valves 412 and 414 of the valve assembly 408 are in their open position to allow a first inductive coupler portion 416 to pass through the gravel pack service tool 406. The first inductive coupler portion 416 (e.g., a male inductive coupler portion) is carried on an electric cable 418 through the valve assembly 408 and an inner bore of a control station 417 to a location that is proximate a second inductive coupler portion 420 (e.g., a female inductive coupler portion) that is part of the lower completion section 402. The second inductive coupler portion 420 is electrically connected to a sensor cable 421 that has sensors.

The lower completion section 402 includes a gravel pack packer 422 that can be set against casing 401 that lines the well. Below the gravel pack packer 422 is a pipe section 424 that extends downwardly to a sand control assembly 426. Below the sand control assembly 426 is another packer 428 that can be set against the casing 401. The sand control assembly 426 is provided adjacent a zone 430 to be produced or injected.

The first inductive coupler portion 416 deployed through the work string 400 acquires data prior to a gravel pack operation, since both ball valves 412 and 414 are in the open position to allow the first inductive coupler portion 416 to be passed to the location proximate the second inductive coupler portion 420.

During the gravel pack operation, the first inductive coupler portion 416 would be removed from the well, and the ball valve 412 in the valve assembly 408 would be actuated to the closed position. The sleeve valve 410 would be actuated to the open position to allow gravel slurry be pumped into the inner bore of the work string 400 to exit to an annulus well region 432 for gravel packing the annulus well region 432.

While the invention has been disclosed with respect to a limited number of embodiments, those skilled in the art, having the benefit of this disclosure, will appreciate numerous modifications and variations therefrom. It is intended that the appended claims cover such modifications and variations as fall within the true spirit and scope of the invention.

What is claimed is:

1. A method for use in a well, comprising:

lowering a gravel pack service tool into the well;

measuring, with at least one sensor located proximate a well region to be gravel packed, at least one characteristic of the well, receiving measurement data produced by the at least one sensor;

sending the measurement data from the at least one sensor to the gravel pack service tool through an inductive coupler;

wherein the measuring is performed during a gravel pack operation by the gravel pack service tool;

removing the gravel pack service tool from the well after the gravel pack operation; and wherein the at least one sensor is part of a lower completion section, and wherein the inductive coupler comprises a first inductive coupler portion that is part of the lower completion section, and a second inductive coupler portion that is part of the gravel pack service tool.

2. The method of claim 1, further comprising performing the gravel pack operation by pumping a gravel slurry through the gravel pack service tool.

3. The method of claim 2, further comprising leaving the at least one sensor in the well region after removing the gravel pack service tool.

4. The method of claim 1, wherein the gravel pack service tool includes a control station electrically connected to the second inductive coupler portion, and wherein sending the measurement data from the at least one sensor to the gravel pack service tool comprises sending the measurement data to the control station.

5. The method of claim 4, wherein the control station includes a processor.

6. The method of claim 4, wherein the control station includes a second sensor, the method further comprising making a measurement with the second sensor.

7. The method of claim 4, wherein the control station includes a memory device for data storage.

8. The method of claim 4, wherein the control station comprises a telemetry module, the method further comprising sending, by the telemetry module, the measurement data to an earth surface location.

9. The method of claim 1, wherein the gravel pack service tool includes an energy source, the method further comprising powering the at least one sensor with the energy source.

10. The method of claim 1, wherein the gravel pack service tool is attached to a wired tubing that has an embedded electric cable, the method further comprising communicating measurement data collected by the at least one sensor over the electric cable that is embedded in the wired tubing.

11. The method of claim 10, further comprising:

communicating the measurement data from the at least one sensor through an inductive coupler to a control station in the gravel pack service tool, wherein communicating the measurement data is from the control station over the electric cable embedded in the wired tubing to a surface controller located at an earth surface.

12. A system for use in a well, comprising:

a lower completion section including a port assembly actuatable to enable gravel packing of an annulus well region;

at least one sensor for placement proximate the annulus well region that is being gravel packed;

a gravel pack service tool retrievably engaged with the lower completion section, the gravel pack service tool to perform the gravel packing of the well region; and a telemetry module to wirelessly communicate measurement data collected by the at least one sensor to a surface controller located at an earth surface.

13. The system of claim 12, wherein the at least one sensor is part of the lower completion section, the system further comprising an inductive coupler to enable communication of measurement data between the at least one sensor and the gravel pack service tool.

14. The system of claim 12, further comprising a wired tubing having an embedded electric cable to enable communication of measurement data from the at least one sensor to an earth surface location.

15. The system of claim 14, further comprising a work string including the gravel pack service tool, wherein the wired tubing is part of the work string.

16. A system for use in a well, comprising:

a lower completion section including a port assembly actuatable to enable gravel packing of an annulus well region;

at least one sensor for placement proximate the annulus well region that is being gravel packed, wherein the at least one sensor is part of the lower completion section;

a first inductive coupler portion electrically connected to the at least one sensor; and a second inductive coupler portion carried on a cable and deployable through a gravel pack service tool for positioning next to the first inductive coupler portion to enable communication of measurement data between the at least one sensor and a surface location, wherein the gravel pack service tool is retrievably engaged with the lower completion section and configured to perform the gravel packing of the well region.

17. The system of claim 16, further comprising a wired tubing having an embedded electric cable to enable communication of measurement data from the at least one sensor to an earth surface location.

18. The system of claim 17, further comprising a work string including the gravel pack service tool, wherein the wired tubing is part of the work string.

* * * * *